US006619398B2

(12) United States Patent
MacKenzie et al.

(10) Patent No.: US 6,619,398 B2
(45) Date of Patent: Sep. 16, 2003

(54) CEMENT DIVERTER SYSTEM FOR MULTILATERAL JUNCTIONS AND METHOD FOR CEMENTING A JUNCTION

(75) Inventors: Alan MacKenzie, Aberdeen (GB); Aubrey C. Mills, Magnolia, TX (US); Douglas J. Murray, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/881,982

(22) Filed: Jun. 15, 2001

(65) Prior Publication Data

US 2002/0053433 A1 May 9, 2002

Related U.S. Application Data

(60) Provisional application No. 60/213,050, filed on Jun. 21, 2000.

(51) Int. Cl.[7] ..... E21B 33/14

(52) U.S. Cl. ..... 166/285; 166/177.4; 166/313

(58) Field of Search ..... 166/285, 313, 166/177.4, 290, 334.4

(56) References Cited

U.S. PATENT DOCUMENTS

| | | | | | |
|---|---|---|---|---|---|
| 4,440,218 | A | * | 4/1984 | Farley | 166/51 |
| 4,709,760 | A | | 12/1987 | Crist et al. | 166/285 |
| 5,024,273 | A | * | 6/1991 | Coone et al. | 166/289 |
| 6,390,196 | B1 | * | 5/2002 | Montaron et al. | 166/290 |
| 2002/0020531 | A1 | * | 2/2002 | Ohmer | 166/290 |

FOREIGN PATENT DOCUMENTS

| | | |
|---|---|---|
| EP | 0585097 A | 8/1993 |
| GB | 2193741 A | 2/1988 |

* cited by examiner

*Primary Examiner*—William Neuder
(74) *Attorney, Agent, or Firm*—Cantor Colburn LLP

(57) ABSTRACT

A cement diverter system and method for cementing a junction in a wellbore wherein a cementing operation and reverse circulating operation are achievable in a single run in the hole.

12 Claims, 15 Drawing Sheets

CEMENT DIVERTER SYSTEM FOR MULTILATERAL JUNCTIONS AND METHOD FOR CEMENTING A JUNCTION

CROSS REFERENCE TO RELATED APPLICATIONS

This application claims the benefit of an earlier filing date from U.S. Provisional Application Serial No. 60/213,050 filed Jun. 21, 2000 which is fully incorporated herein by reference.

BACKGROUND

Prior Art

Since the adventive lateral wellbores thought in engineering time has been devoted to cementing the junction between the lateral wellbore and the primary wellbore. Cementing of the junction provides structural stability and in some cases also pressure-tight sealing. It is also in some circumstances desirable to cement portions of each wellbore near the junction. While use of practice in the field have enabled operators to successfully cement areas they choose to. It is also a common place for cement to spill over from the area desired into other areas where such cement is not desired. One location in which such spill over is common is in the area of junctions and multilateral wellbores. Therefore, it would be desirable for the art to be provided a means by which cement can be placed in the location desired but would ensure that additional cement did not spill over into other portions of the wellbore where it was not desired.

SUMMARY

The above-identified drawbacks of the prior art are overcome, or alleviated, by the disclosed cement diverter system and method for cementing a junction.

A tool is deliverable downhole which upon an appropriate sequence of landing on no go shoulders, slacking weight and pulling up, provides pathways for both the cementing operation and a reverse circulating operation, to cement and then remove all excess cement from the wellbore. The device and method provide for reliable cementing of desired areas in the wellbore while ensuring that all cement in excess of the desired amount is removed from the wellbore by delivering excess cement to the surface in a reverse circulating operation. The effect is a significant benefit to the art in that errant cement is not left downhole where it generally causes a plethora of difficulties. Moreover, all of the functions of the invention are achieved in a single run.

BRIEF DESCRIPTION OF THE DRAWINGS

Referring now to the drawings wherein like elements are numbered alike in the several FIGURES.

DETAILED DESCRIPTION OF THE INVENTION

Referring to FIGS. 1–8, the cementing system is illustrated in a run-in position. Moreover the tool is illustrated independently of any downhole apparatus to promote a clear understanding of the tool itself. Reference will be made hereunder to figures in which the tool is located within a wellbore and is in one of its operating positions.

Figure 1:
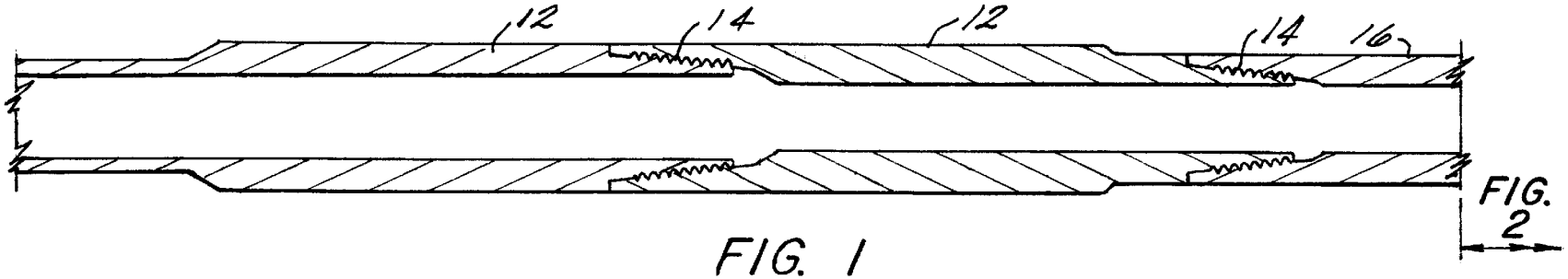
FIGS. 1–8 illustrate a single tool in an elongated view in the run-in position.

FIG. 1 illustrates space out subs 12 which are needed to properly position the tool downhole. In general, spaceout subs are commercially available components used for many different downhole tools and devices and will be understood by one of ordinary skill in the art. Such subs 12 may be obtained in varying lengths and are attachable to other subs or tools by threaded connections 14. Connected to subs 12 is an adjustment mandrel 16 partially illustrated in FIG. 2. Mandrel 16 preferably comprises a plurality of annular grooves 18 machined into an outer surface 20 of mandrel 16. Grooves 18 allow for adjustment of the length of the assembled tool which is important due to no-go shoulders that are spaced out in the borehole. The importance of this adjustment will become clear when more has been discussed hereunder about the componentry and operation of the tool.

Figure 2:
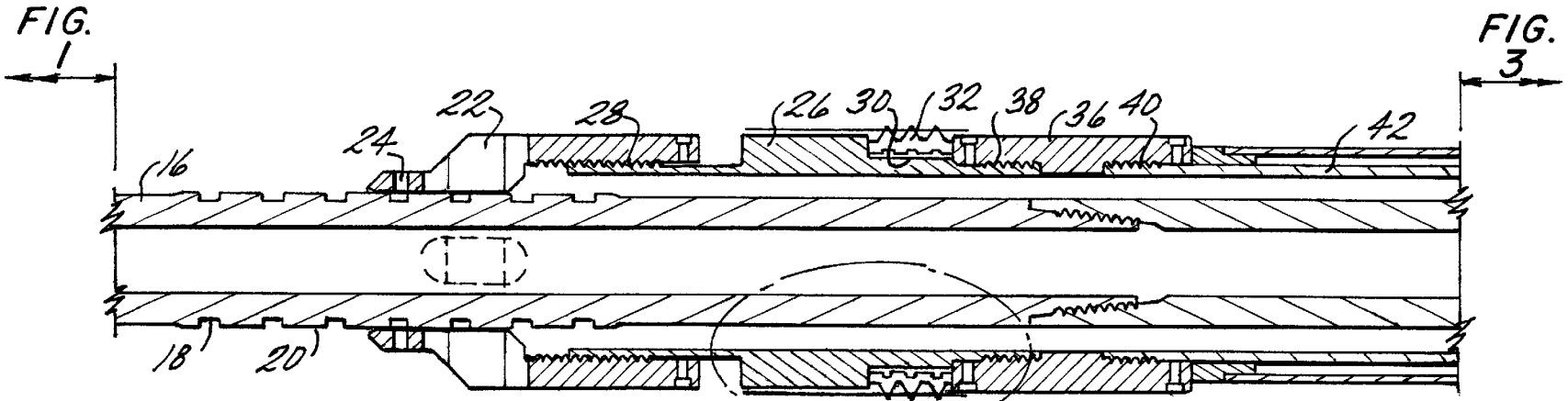
Figure 10A:
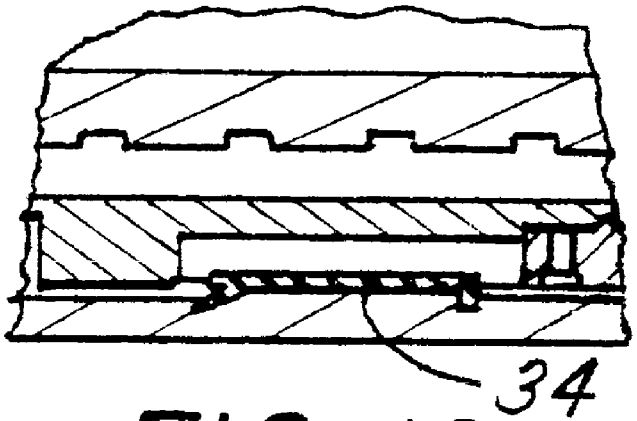
FIGS. 9–18 are another illustration of the tool of the invention illustrated installed in a wellbore near a lateral junction and wherein the tool is illustrated partway through it's operational positions.
Figure 2A:
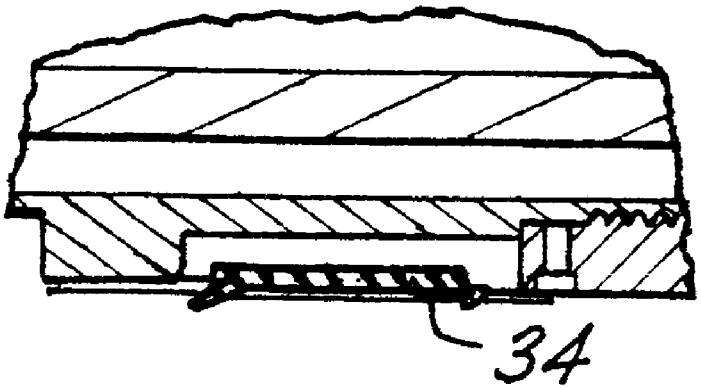
Figure 3:
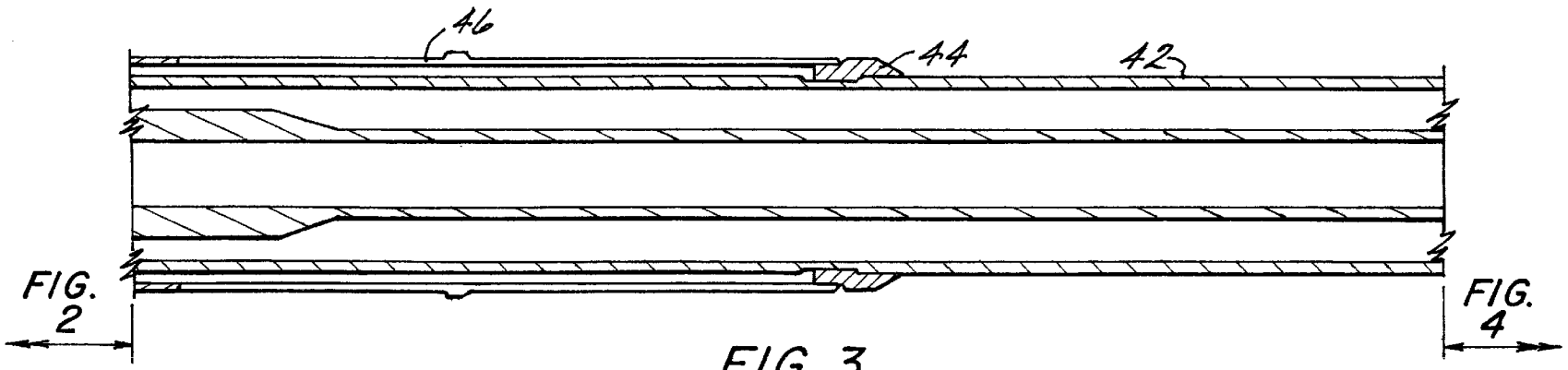

Referring still to FIG. 2, a shear sub 22 is connected to mandrel 16 by a plurality of shear screws 24 utilizing one of the grooves 18 in mandrel 16. Shear sub 22 is connected at a downhole end thereof to seal sub 26 which is threadedly connected to shear sub 22 at thread 28. Seal sub 26 is preferably provided with a reduced outside diameter section 30 which receives a seal 32. Many different kinds of seals may be inserted within section 30. It will be appreciated that two different types of seals are illustrated in the drawing FIGS. 2 and 2*a* (and 10 and 10*a*): one as seal 32 (FIGS. 2 and 10) and another as seal 34 (FIGS. 2*a* and 10*a*). Both seals (32 and 34) are known to the art and can easily be substituted by other types of seals. Regardless of type, seal 32 or 34 are preferably maintained in position by seal block ring 36 which is threadedly attached to seal sub 26 by thread 38. At a downhole end of block ring 36, the ring is further connected via thread 40 to inner sleeve 42. Sleeve 42 supports a ring 44 (FIG. 3) which locates outer sleeve 46.

Figure 4:
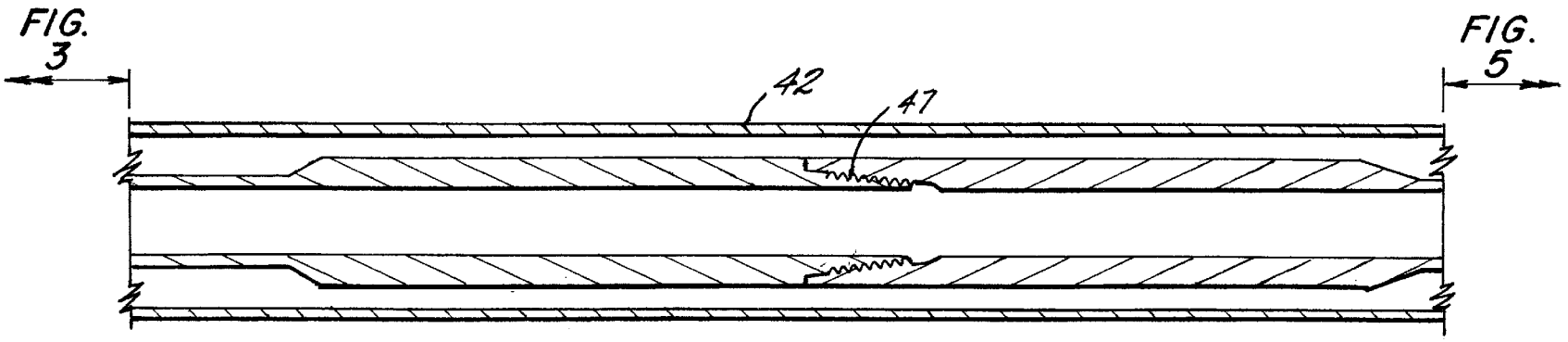
Figure 5:
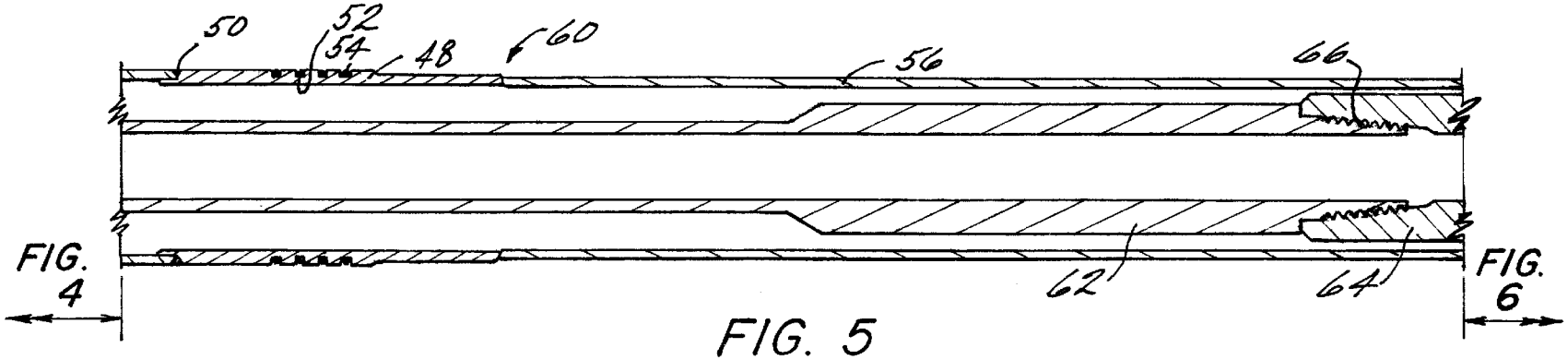

Inner sleeve 42 continues downhole through FIG. 4 and into FIG. 5. Sleeve 42 is preferably welded to a profiled ring 48 at weld 50 for ease of manufacture. It will be appreciated however that ring 48 may be machined on sleeve 42 with identical practical results. Ring 48 preferably contains four grooves 52 for o-rings 54 or other sealing elements (not shown).

Figure 14:
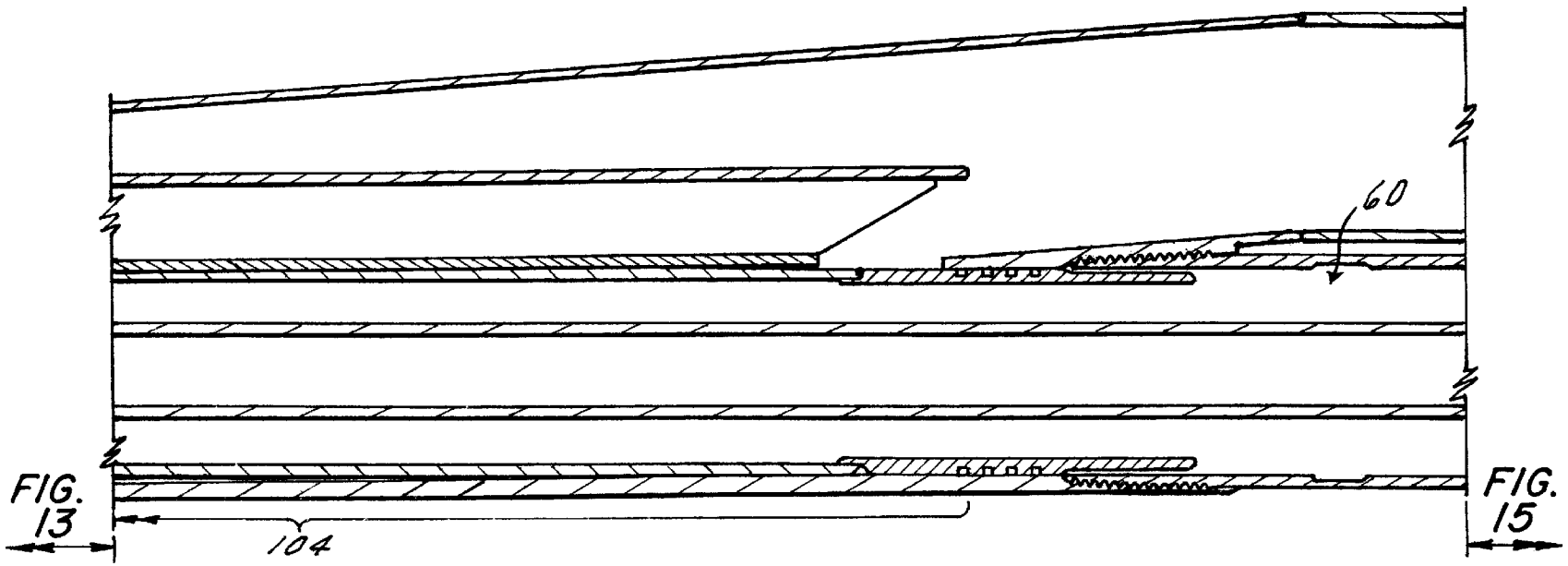
Figure 15:
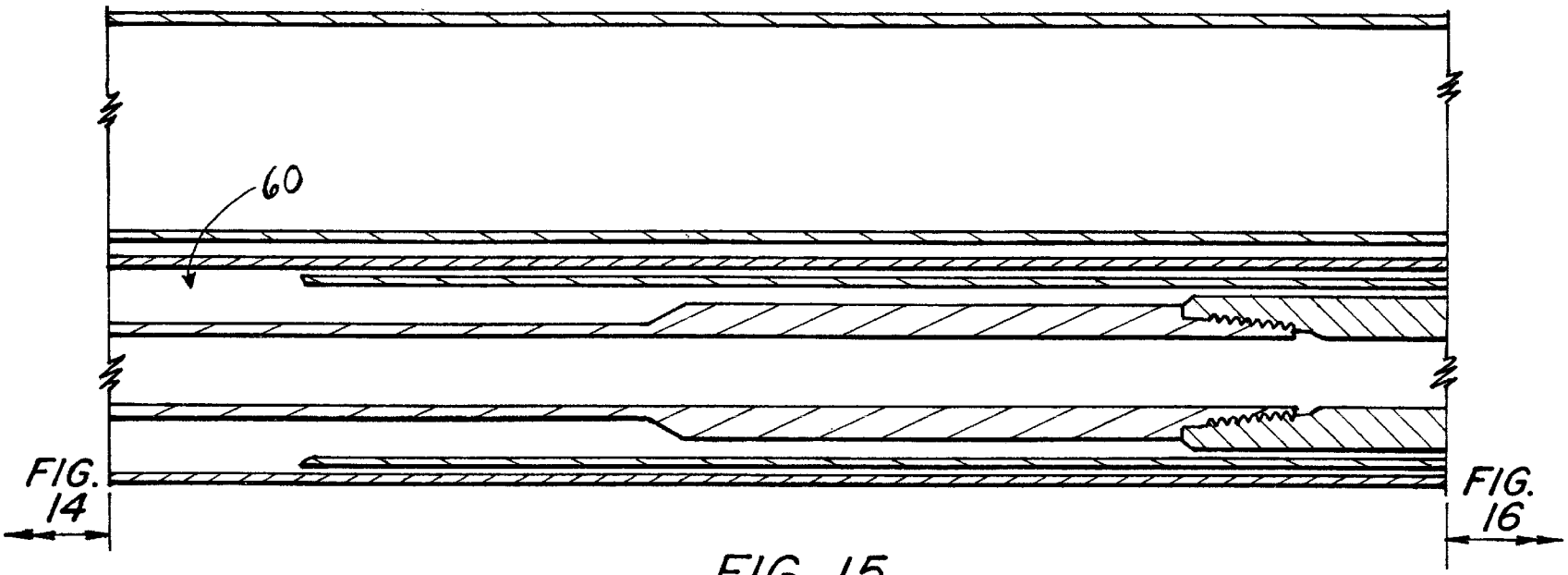
Figure 16:
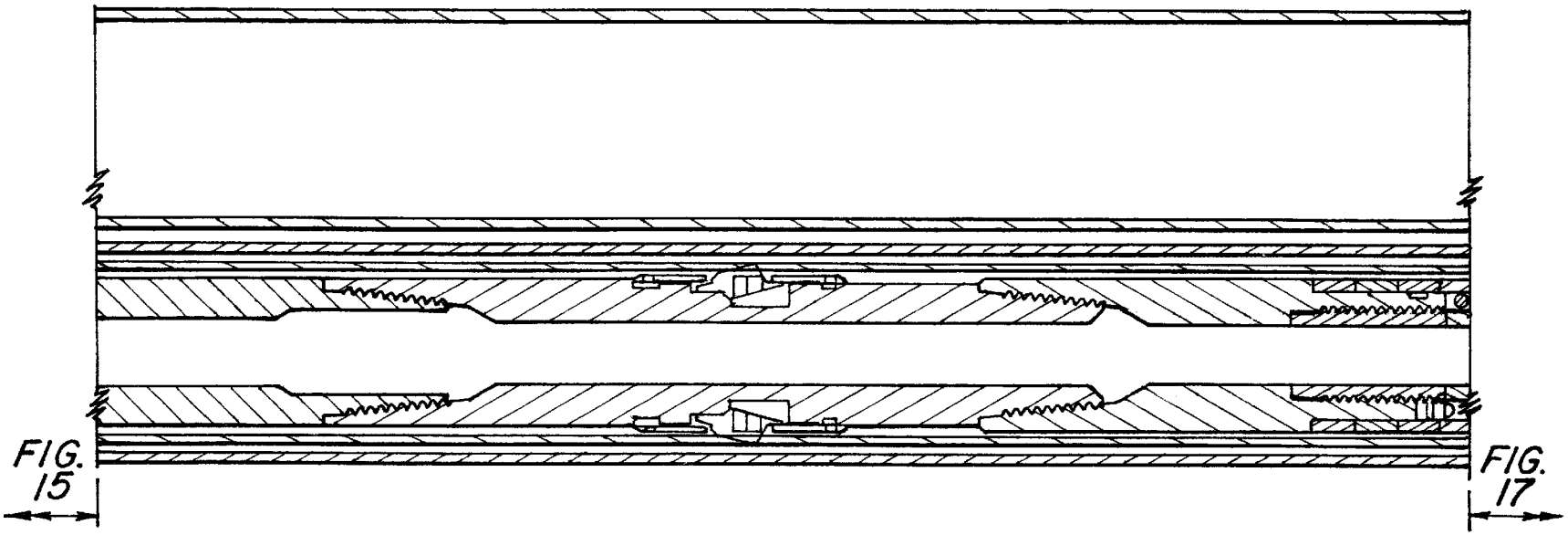
Figure 17:
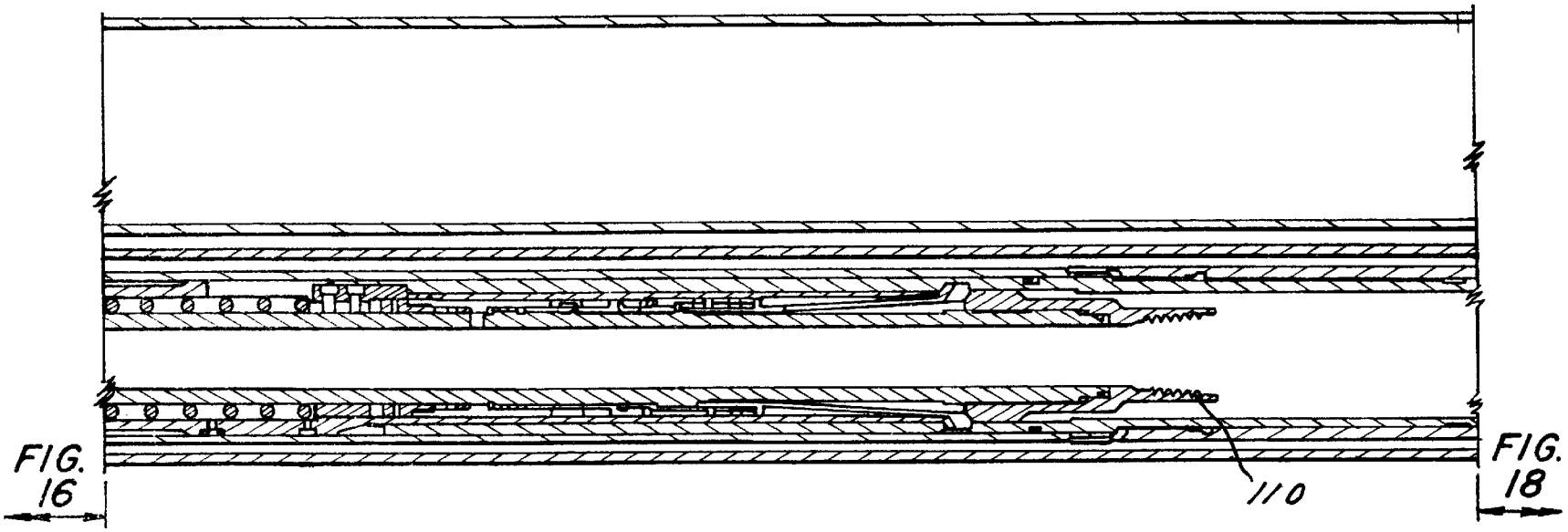
Figure 18:
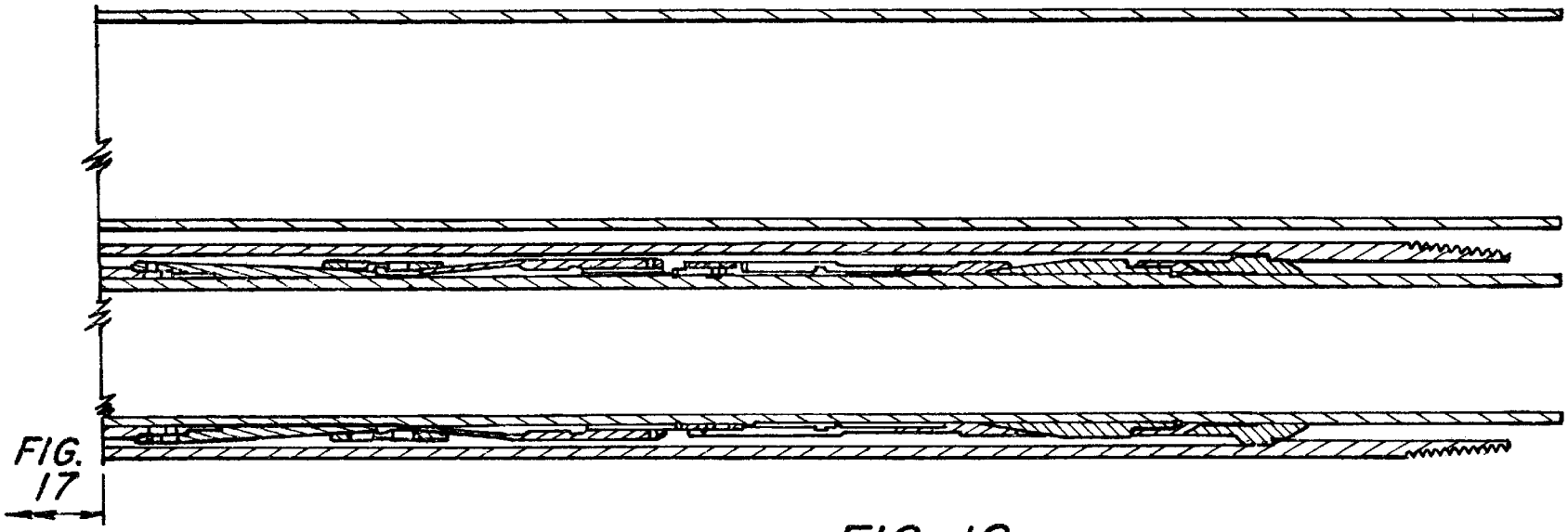
Figure 19:
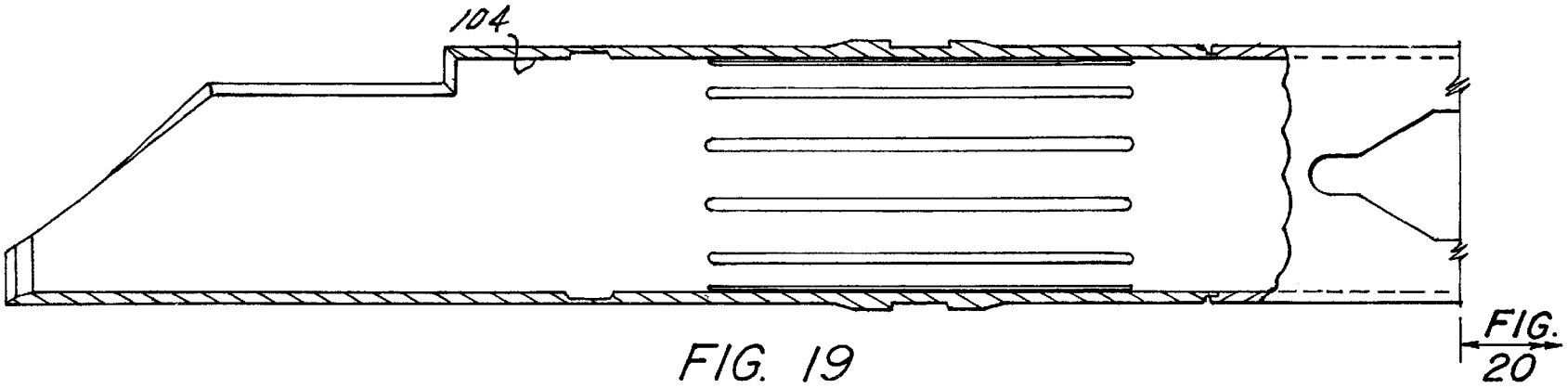
FIGS. 19–22 are an elongated view of the lateral bore shield.
Figure 20:
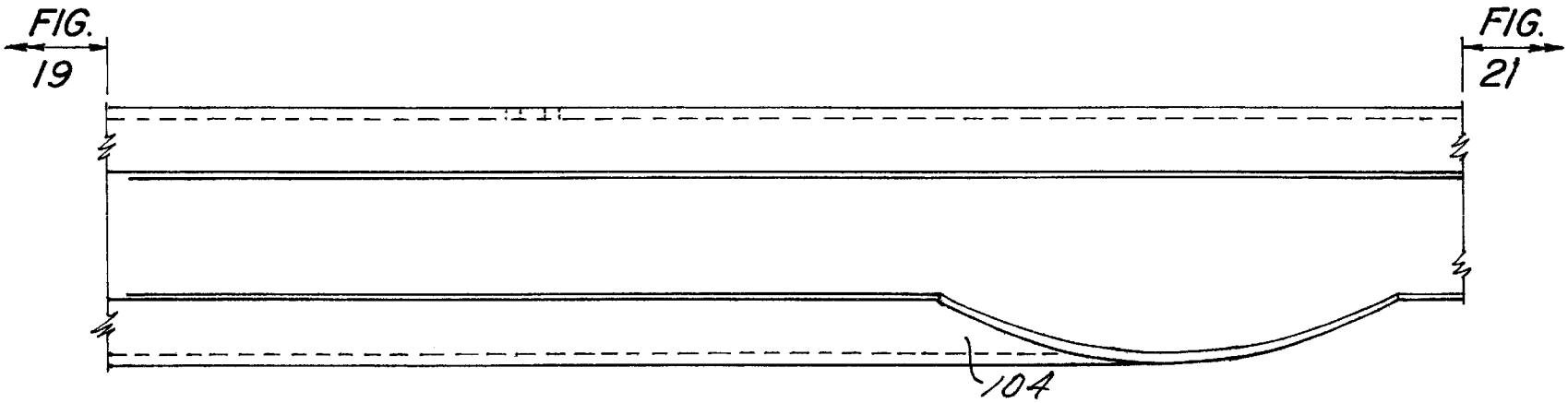
Figure 21:
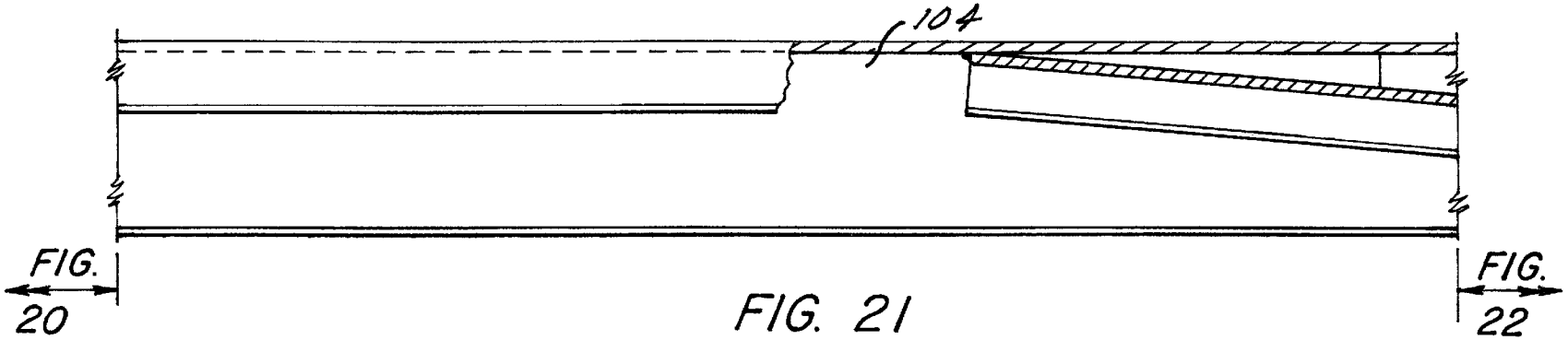
Figure 22:
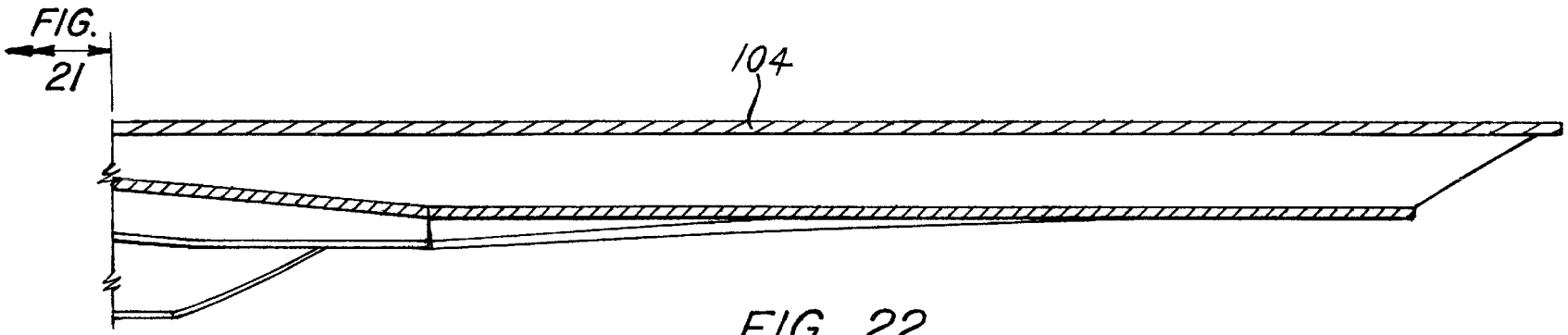

Referring to FIG. 5, the tool in the run-in position, a cement sleeve 56 is illustrated in contact with ring 48. Transfer of fluid through this contact area is inhibited. During operation of the tool however ring 48 and cement sleeve 56 are moved away from each other to open an annular port 60 (visible in FIGS. 14 and 15) in the tool for flow of cement. The operation resulting in such opening is described hereunder.

Figure 6:
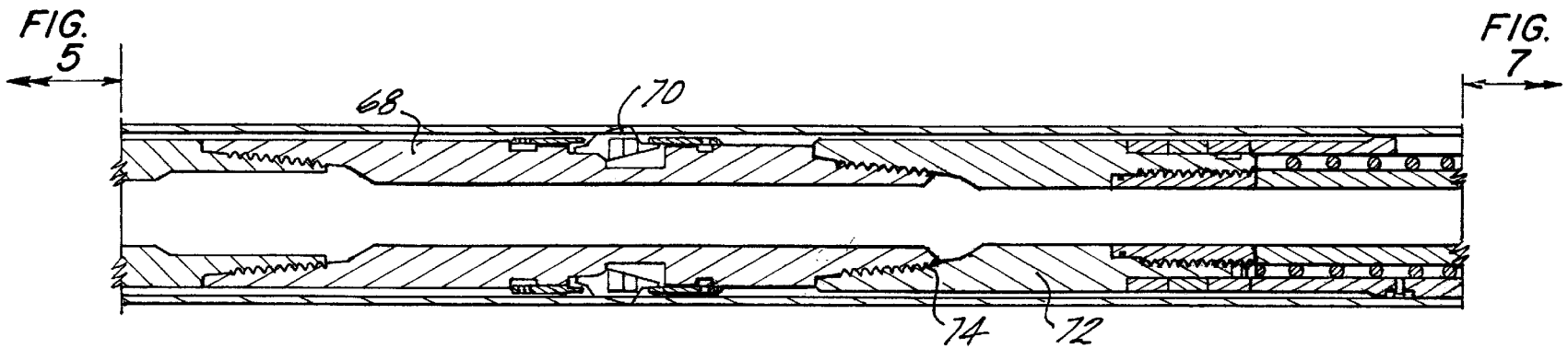
Figure 7:
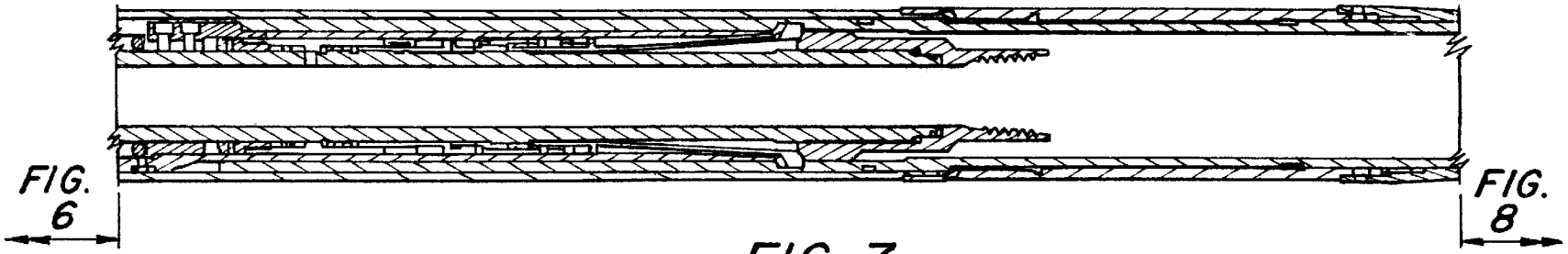
Figure 8:
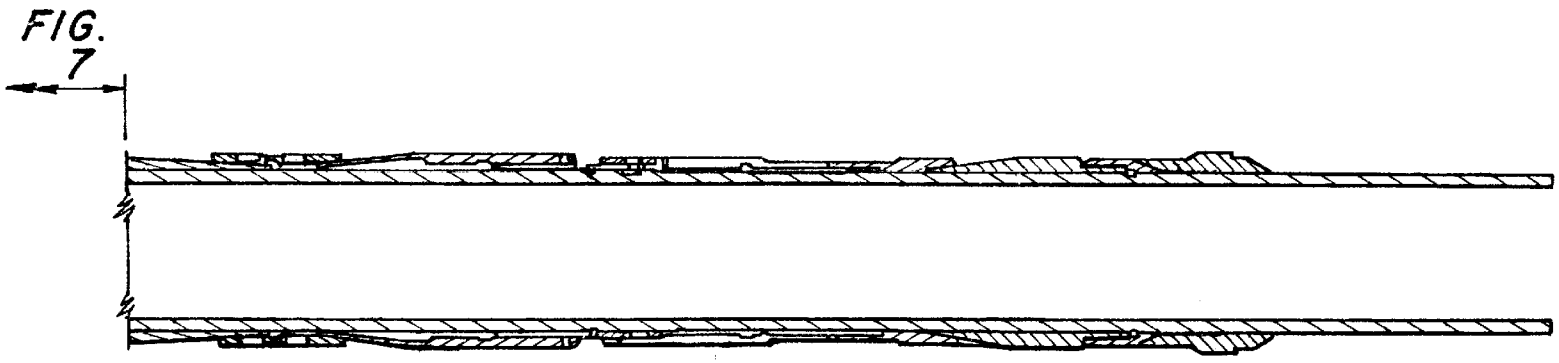
Figure 9:
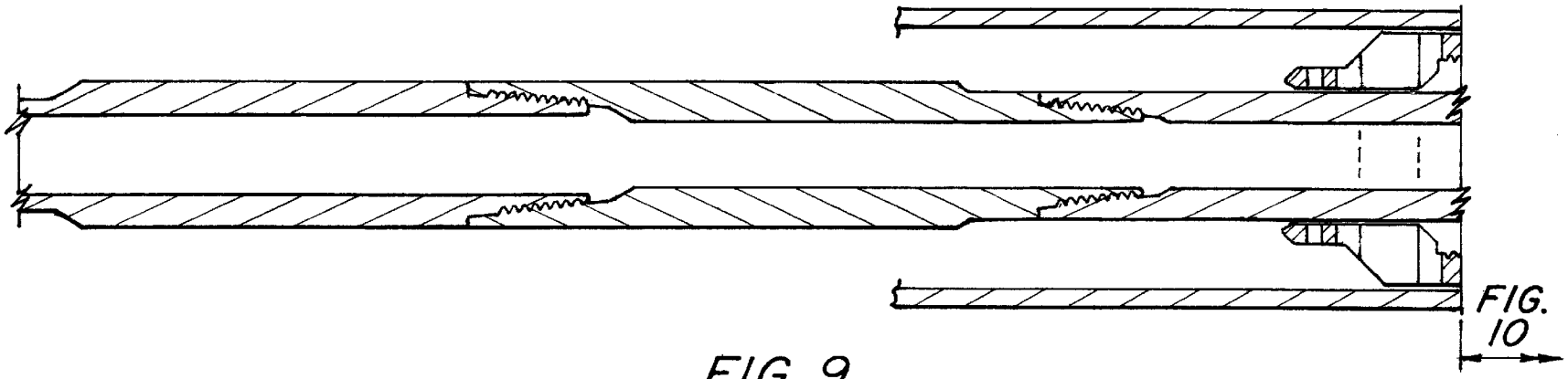

One of skill in the art will recognize the commercially available part number 265-20-0076 (Baker Oil Tools, Houston, Tex.) commonly known as a lift nipple identified by numeral 62 which is located within cement sleeve 56 and is attached at a downhole end by thread 66 to part number 469-01-2305 (Baker Oil Tools, Houston, Tex.) commonly known as a crossover sub and identified by numeral 64. As is appreciated by one of skill in the art and implied by its name, this sub merely mates different types of threads on existing tools. Further downhole, referring now to FIG. 6 is dog setting sub 68, Baker Oil Tools, Houston, Tex., part number 270-09-0138 which provides dogs 70, whose function is later described. Downhole of dog setting sub 68 is an HR setting tool 72 which is commercially available from Baker Oil Tools, Houston, Tex. as part number 266-66-0003. Tool 72 is connected to sub 68 by thread 74. Attached to tool 72 is a packing device known under the trademark ZXP packer and which is commercially available from Baker Oil Tools, Houston, Tex. One of ordinary skill in the art is fully knowledgeable about how such packer works and it is not necessary to discuss such here.

With reference to FIGS. 9–18, the cement diverter system is illustrated inside a casing 100 in the downhole environment. The casing 100 as illustrated is a section of a multilateral wellbore in the vicinity of a junction which is identifiable by one of skill in the art in FIG. 14 by the divergence of a single bore into two bores. The cement diverter system preferably employs a lateral bore shield device 104. The device, which is a prior art device, is illustrated in FIGS. 19–22 independently to clarify its components. One of ordinary skill in the art will recognize the device and further explanation thereof is not necessary.

Figure 10:
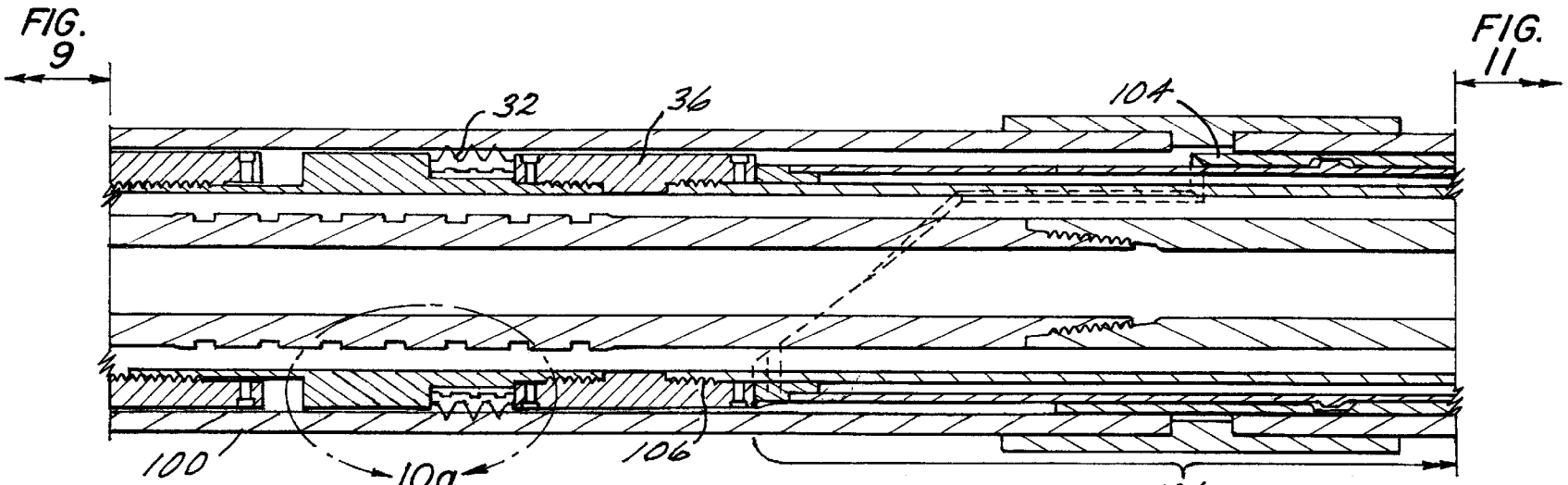
Figure 11:
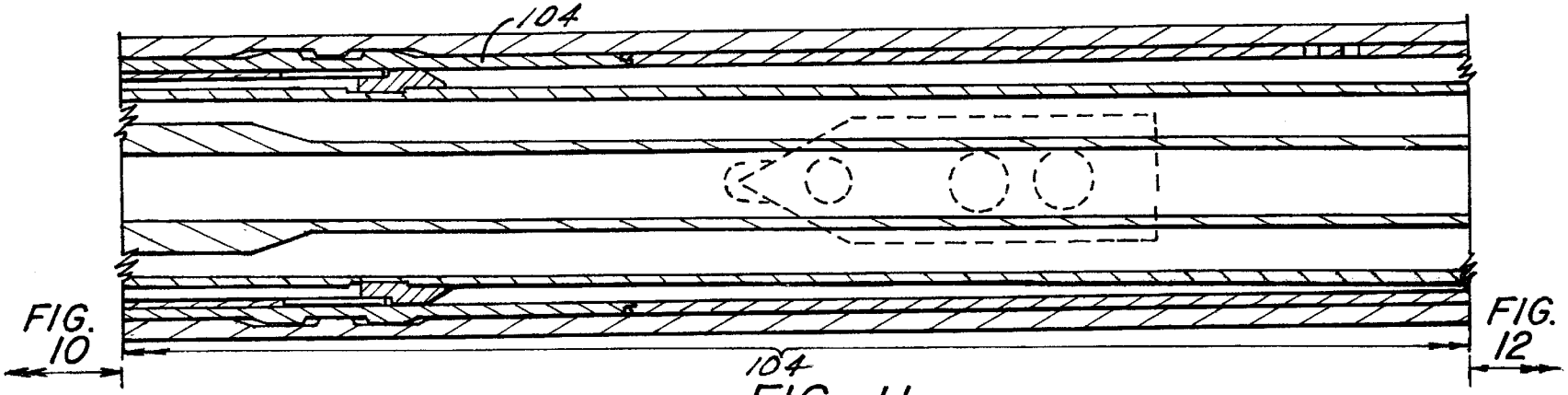
Figure 12:
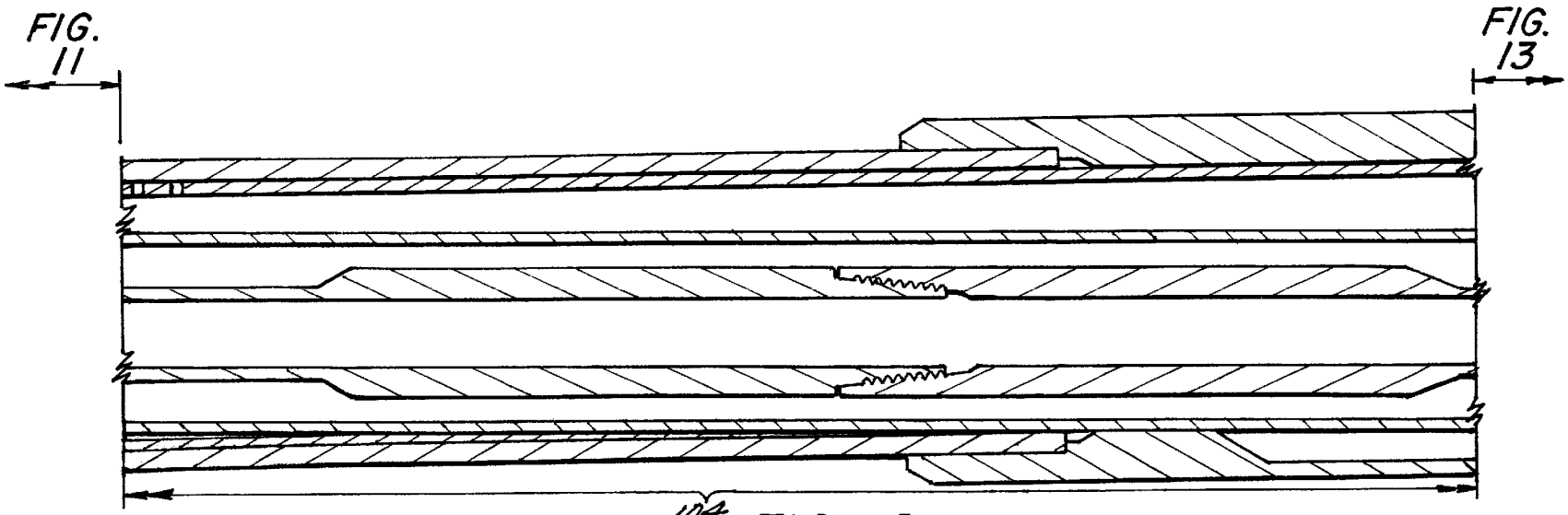
Figure 13:
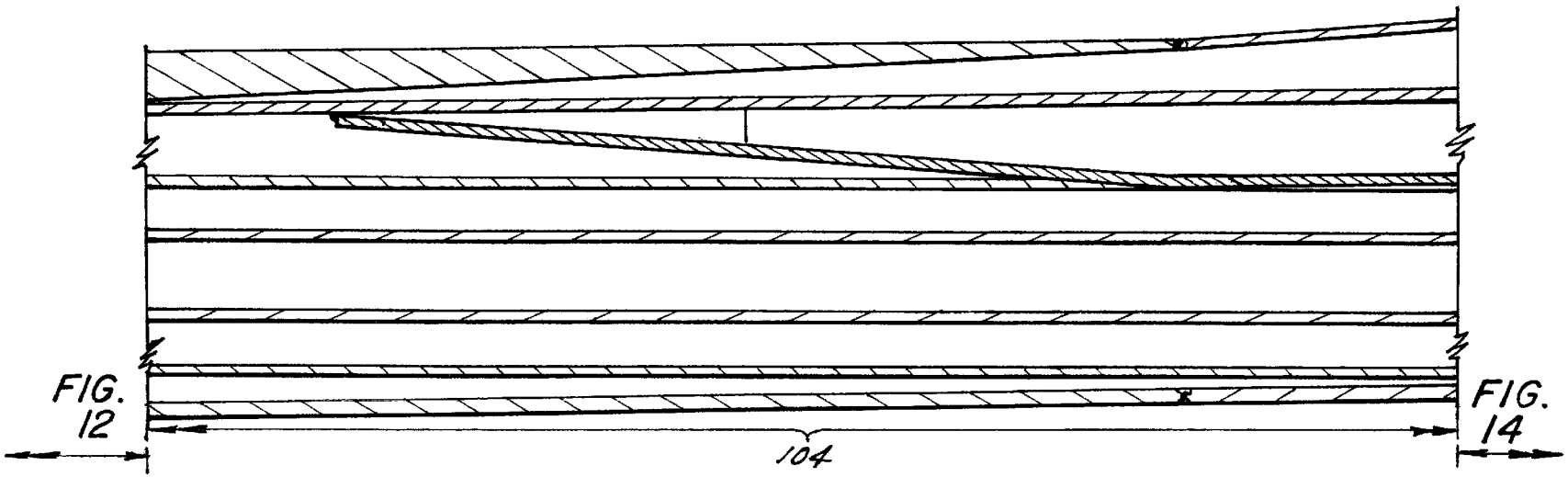

Referring to FIG. 10, seal block ring 36 lands on shoulder 106 of shield 104. Upon slacking of weight, shear screws 24 shear and allow mandrel 16 to move downhole. This leaves the exterior portion of the tool in place and supported by shoulder 106. Because of the relative displacement of mandrel 16 to the other components of the tool, and referring to FIGS. 5, 14 and 15, annular port 60 is opened (compare FIG. 5 to FIGS. 14 and 15). This results from cement sleeve 56 moving downhole with mandrel 16 and ring 48 (and attached components) not moving downhole. Annular opening 16 is important to the system since it allows for cement to return to the mandrel 16. It is in this condition of the tool that the cement is pumped downhole and allowed to permanently mount the lower portion of the tool and cement the junction.

Following conclusion of the cement pumping operation, mandrel 16 is pulled up a sufficient amount to allow dogs 70 to clear edge 108 of cement sleeve 56 whereafter the dogs expand radially automatically. Setdown weight of the tool through dogs 70 onto edge 108 causes a pack off of the lower portion of the tool (the ZXP packer). This, as one of skill in the art will recognize, is a mechanical pack off. The effect of the pack off is to seal in the cement and ready the tool for a reverse circulating operation to clear unwanted cement downhole. To accomplish the reverse circulation the mandrel 16 is pulled uphole a sufficient distance to cause the downhole end 110 thereof to clear the edge 108 of cement sleeve 56. Reverse circulation is then undertaken resulting in a junction cleaned of excess cement while leaving all desired cement intact.

Upon completion of the reverse circulating operation an upper portion of the tool which is described as all portions thereof uphole of edge 108 of cement sleeve 56, is removed from the hole. Once this uphole portion of the tool and the shield 104 are removed from the wellbore junction is prepared for further operations.

While preferred embodiments have been shown and described, various modifications and substitutions may be made thereto without departing from the spirit and scope of the invention. Accordingly, it is to be understood that the present invention has been described by way of illustration and not limitation.

What is claimed:

1. A cement diverter system for a wellbore comprising:

a mandrel;

a separation sub mounted to said mandrel with at least one detachable fastener;

an inner sleeve and profiled ring attached to said separation sub;

a cement sleeve in fluid passage inhibiting contact with said inner sleeve and profiled ring, said cement sleeve being displaceable from contact with said inner sleeve and profiled ring; and a pack off assembly attached to said mandrel.

2. A cement diverter as claimed in claim 1 wherein upon detaching of said at least one detachable fastener said cement sleeve is displaceable.

3. A cement diverter as claimed in claim 1 wherein said mandrel includes a plurality of grooves facilitating adjustability of said system.

4. A cement diverter as claimed in claim 1 wherein said inner sleeve and said profiled ring are integral.

5. A cement diverter as claimed in claim 1 wherein said inner sleeve and said profiled ring are independent attached components.

6. A cement diverter as claimed in claim 1 wherein said pack off assembly includes a lifting nipple, a dog setting tool, a setting tool and a packer.

7. A cement diverter as claimed in claim 6 wherein said pack off assembly includes a set of dogs.

8. A cement diverter as claimed in claim 7 wherein said dogs are maintained in a collapsed position during tool run-in.

9. A cement diverter as claimed in claim 7 wherein said dogs extend upon withdrawal of said mandrel from said cement sleeve.

10. A cement diverter as claimed in claim 9 wherein setdown weight on said cement sleeve through said dogs causes setting of said packer.

11. A method for connection a junction in a multilateral wellbore comprising:

running a cement diverter system as claimed in claim 1;

landing said separation sub on a shoulder;

slacking weight to detach said detachable fastener;

displacing said cement sleeve and pack off assembly downhole;

landing said pack off assembly on a second shoulder;

pumping cement;

picking up on said mandrel to move a set of dogs out of said cement sleeve;

setting weight down on said cement sleeve through said dogs to pack off said pack off assembly;

reverse circulating said system to remove excess cement from said junction.

12. A method as claimed in claim 11 wherein said method includes removing said system from said wellbore.

* * * * *